United States Patent [19]

Nordlof

[11] Patent Number: 4,753,381

[45] Date of Patent: Jun. 28, 1988

[54] STOCK FEED APPARATUS

[76] Inventor: Richard D. Nordlof, 3312 Crest Rd., Rockford, Ill. 61107

[21] Appl. No.: 25,735

[22] Filed: Mar. 13, 1987

Related U.S. Application Data

[63] Continuation-in-part of Ser. No. 829,210, Feb. 14, 1986, Pat. No. 4,669,645.

[51] Int. Cl.[4] ..... B65H 20/00; B65H 23/06

[52] U.S. Cl. ..... 226/134; 226/147; 226/150; 226/158; 226/162

[58] Field of Search ..... 226/134, 136, 147, 149, 226/150, 158, 162

[56] References Cited

U.S. PATENT DOCUMENTS

| | | | |
|---|---|---|---|
| 3,038,645 | 6/1962 | Nordlof | 226/162 X |
| 4,095,733 | 6/1978 | Scribner | 226/162 |
| 4,175,688 | 11/1979 | Scribner | 226/158 |
| 4,669,645 | 6/1987 | Nordlof | 226/134 |

*Primary Examiner*—Stuart S. Levy
*Assistant Examiner*—Lynn M. Sohacki
*Attorney, Agent, or Firm*—Vernon J. Pillote

[57] ABSTRACT

A fluid operated stock feed apparatus for intermittently advancing stock along a feed path. The feed apparatus includes a stationary body having fluid operated stock holding clamps mounted thereon. A stock feed head is mounted for reciprocation relative to the body and has fluid operated stock feed clamps mounted thereon and a feed piston is mounted in the body for extending and retracting the stock feed head. A main control valve is provided in the body for controlling the application of fluid pressure to the fluid pressure operated stock holding and stock feed clamps and a pressure operated auxiliary valve is provided in the body and is responsive to the pressure from the main control valve for controlling the application of fluid pressure to the feed piston. The main body is formed with a main bore therethrough and the feed cylinder is provided in one portion of the main bore and the pressure operated auxiliary valve including an auxiliary valve casing, an auxiliary valve member and a pressure actuator therefor, is mounted in another portion of the main bore at one end of the feed cylinder. The feed cylinder is formed by a sleeve disposed in the bore and arranged to provide a pressure chamber around the sleeve.

8 Claims, 3 Drawing Sheets

STOCK FEED APPARATUS

CROSS REFERENCE TO RELATED APPLICATION

This application is a continuation-in-part of the copending application of Richard D. Nordlof, Ser. No. 829,210, filed Feb. 14, 1986, now U.S. Pat. No. 4,669,645 issued June 2, 1987.

BACKGROUND OF THE INVENTION

This invention relates to fluid operated stock feed apparatus for intermittently advancing strip stock along a feed path and particularly to improvements in fluid operated stock feed apparatus of the type disclosed in the applicant's prior U.S. Pat. No. 3,038,645. The stock feed apparatus disclosed in that patent in general included a stationary body, a fluid operated stock holding clamp mounted on the body, a feed head mounted for reciprocation relative to the body and having a fluid operated stock feed clamp mounted theron, and a fluid operated feed piston slidably mounted in a feed cylinder bore in the stationary body for extending and retracting the feed head relative to the stock holding clamp. A main control valve was mounted on the body for controlling application of fluid pressure to the fluid operated stock holding clamp and stock feed clamp, and an auxiliary valve was mounted in a stepped valve bore in the body and operated by fluid pressure from the main control valve to control the application of fluid pressure to the feed piston to extend and retract the feed head in timed relation with the operation of the stock holding and stock feed clamps.

While the prior stock feed apparatus operated satisfactorily, it was somewhat expensive to machine and assemble. It was necessary to machine a feed cylinder bore and a separate stepped valve bore in the body, and to machine numerous holes or passages in the body to interconnect the main valve and the auxiliary valve and the fluid operated stock feed and holding clamps and the fluid operated feed piston and some of these passages were at angles that were not orthogonal to the axis of the feed cylinder. The feed piston was slidably mounted directly in the feed cylinder bore and it was accordingly necessary to machine the feed cylinder bore to a smooth finish.

SUMMARY OF THE INVENTION

An important object of the present invention is to provide an improved fluid operated stock feed apparatus of the type described which can be more economically machined and assembled.

Accordingly, the present invention provides a fluid operated stock feed apparatus including a stationary body having a fluid operated stock holding clamp mounted thereon, a feed head mounted for reciprocation relative to the stock holding clamp, a main control valve mounted on the body for controlling application of fluid pressure to the fluid operated stock holding clamp and stock feed clamp, and an auxiliary valve operated by fluid pressure from the main control valve and arranged to control the application of fluid pressure to the feed piston to extend and retract the feed head in timed relation with the operation of the stock holding and stock feed clamps, and in which the feed piston is slidably mounted in one portion of a bore in the body and the auxiliary valve including an auxiliary valve casing, auxiliary valve member and fluid pressure operator therefor are removably mounted in a second portion of the bore coaxial with the feed piston, to control the application of fluid pressure to the feed piston.

In accordance with another aspect of this invention a fluid operated stock feed apparatus of the type set forth above, is provided with an improved feed cylinder means in which a sleeve is removably mounted in the bore in the stationary body to provide a cylinder inside the sleeve for the feed piston and a pressure chamber between the sleeve and the bore for transmitting fluid pressure to the rod end of the feed piston.

Figure 1:
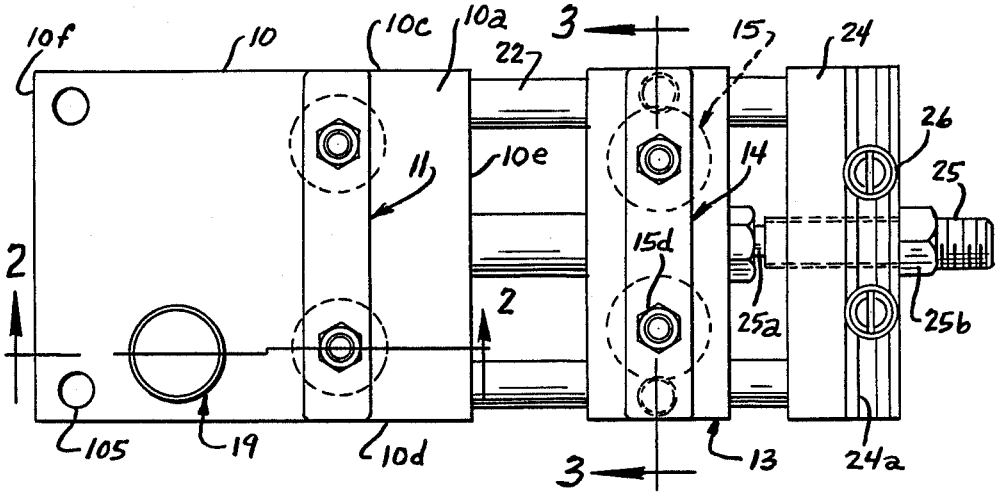
FIG. 1 is a top plan view of the stock feed apparatus with the stock feed head in an intermediate position.

The stock feed apparatus of the present invention is adapted for intermittently feeding strip stock to a punch press or the like in timed relation with the operation of the press. As disclosed more fully in the aforementioned U.S. Pat. No. 3,038,645, the stock feed apparatus is arranged to be mounted on a punch press or the like, as by attachment to the bolster plate of the press to feed stock to the press, and the main control valve is operated as by a valve actuator carried by the press ram to cycle the stock feed apparatus in timed relation with the reciprocation of the ram.

In general, the stock feed apparatus includes a stationary body 10 and a stock holding clamp 11 mounted on the body and actuated from a stock release to a stock engaging position by a fluid pressure operated means 12. A stock feed head 13 is mounted for reciprocation relative to the body in a direction paralleling the path of stock advance and a stock feed clamp 14 is mounted on the feed head and operated from a stock release to a stock engaging position by fluid pressure actuators 15. The body has a cylindrical main bore 20 extending in a direction paralleling the feed path. A feed cylinder means 16 is provided in a first portion of the bore 20 in the body and a feed piston 17 is slidable in the feed cylinder means and has its piston rod connected to the feed head for extending and retracting the same. A pressure operated auxiliary control valve means 18 is provided in a second portion of the main bore 20 for controlling the application of fluid pressure to the feed piston. A main control valve 19 is provided in the body for controlling the application of fluid pressure to the fluid actuators for the stock holding and stock feed clamps and for also controlling the application of fluid pressure to the pressure operated auxiliary valve means.

Figures 4, 5, 6:
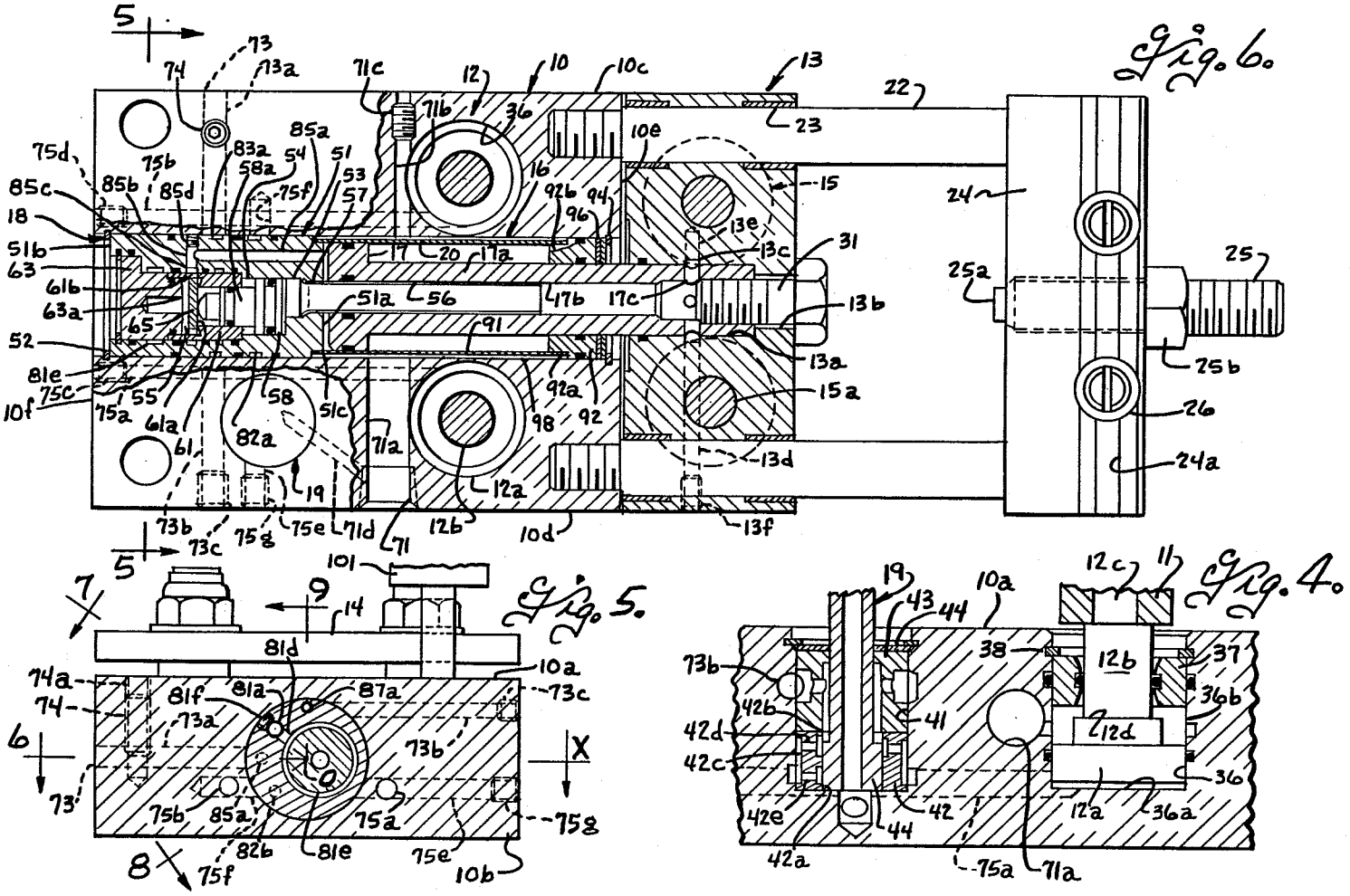
FIG. 4 is a fragmentary longitudinal sectional view taken on the plane 2—2 in FIG. 1 and illustrating the parts on a large scale and in a moved position.
FIG. 5 is an end elevational view of the stock feed apparatus.
FIG. 6 is a fragmentary horizontal sectional view through the stock feed apparatus taken on the plane 6-0-X of FIG. 5.

The stationary body 10 is conveniently in the form of a generally rectangular block having upper and lower side faces 10*a*, 10*b*, side edges 10*c* and 10*d* and end faces 10*e* and 10*f*. A pair of generally parallel guide rods 22 are mounted on the body 10 and extend from one end 10*e*, and the feed head 13 is slidably supported on the guide rods as by bushings 23. A crosshead 24 extends between the outer ends of the guide rods 22 and an adjustable stop 25 is mounted on the crosshead as by threaded engagement therewith to limit the stroke of the feed head. As best shown in FIGS. 1 and 6, the stop 25 has a nose 25*a* arranged to engage a part on the feed head 13, and the stop is adjustable in the crosshead 24 and is adapted to be locked in adjusted position by a lock nut 25*b*. Strip guides 26 are provided on the crosshead 24 to laterally guide the strip stock and the strip guides are advantageously mounted as in a slot 24*a* in the crosshead for adjustment in a direction crosswise of the feed path, to accommodate stock of different width.

Figure 3:
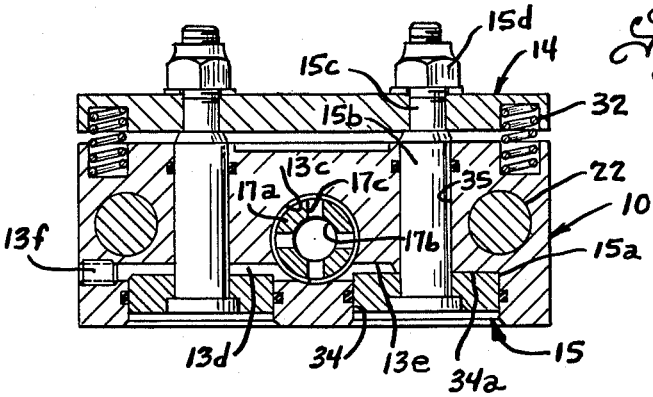
FIG. 3 is a transverse sectional view through the stock feed head taken on the plane 3—3 of FIG. 1 and illustrating the parts on a larger scale than FIG. 1.

The stock feed piston 17 has a piston rod 17*a* extending from one side of the piston and out of the feed cylinder and into a counterbore 13*a* in the feed head (see FIG. 6), and a bolt 31 extends through an opening 13*b* in the feed head and is threaded into the end of the piston rod 17*a* to secure the feed head to the piston rod for movement therewith. As best shown in FIG. 3, the stock feed clamp 14 is yieldably biased to a stock release position by springs 32. The fluid actuators 15 for the stock feed clamp comprise a pair of pistons 15*a* slidably mounted in cylinders 34 formed in the underside of the feed head 13 and the pistons 15*a* have piston rods 15*b* extending upwardly through bores 35 in the feed head. The stock feed member 14 is attached to reduced diameter extensions 15*c* on the upper ends of the piston rods 15*b*, as by nuts 15*d*. A means such as O-rings are provided to form a sliding seal between the periphery of the pistons 15*a* and the cylinders 34 and also between the piston rods 15*b* and the bore 35 to seal the fluid pressure chamber 34*a* at the upper or rod side of the piston. As best shown in FIG. 6, the rod 17*a* of the feed piston 17 is formed with an axial passage 17*b* and lateral passages 17*c* that communicate one end of the axial passage 17*b* with a pressure distribution groove 13*c* in the counterbore 13*a*, and passages 13*d* and 13*e* are formed in the feed head to communicate the pressure distribution groove 13*c*. The end of the hole is thereafter closed with a plug 13*f*.

Figure 2:
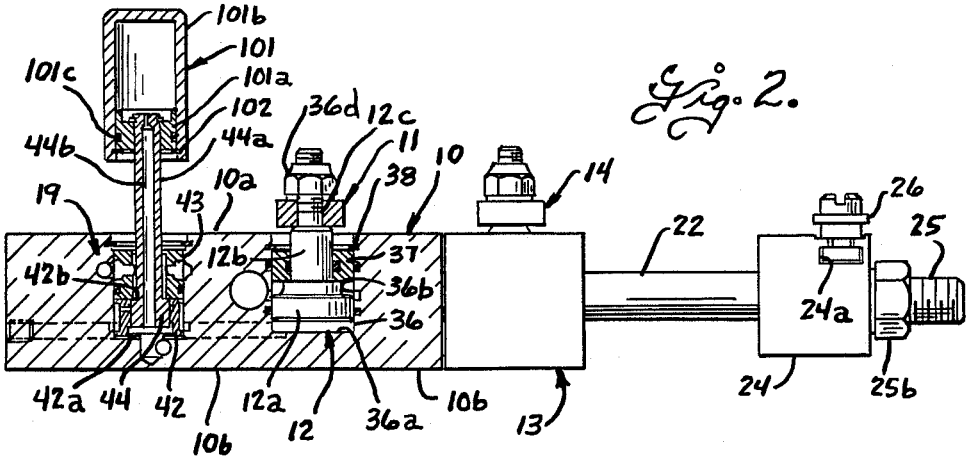
FIG. 2 is a side elevational view of the stock feed apparatus with parts broken away along a section line 2—2 of FIG. 1 to illustrate details of construction.

As best shown in FIGS. 2 and 4, the fluid pressure operated means 12 for the stock holding clamp 11 comprises a pair of cylinders 36 formed in the body 10 at opposite sides of the feed cylinder means 16, the cylinders being closed at their lower ends and having an annular sealing gland 37 removably retained in the cylinders intermediate their ends as by a split retainer ring 38. The fluid pressure operated means 12 also includes clamp pistons 12*a* slidably disposed in the lower portion of the cylinder 36 and rods 12*b* that slidably extend through the respective sealing gland 37. The rods 12*b* have reduced diameter upper ends 12*c* secured to the stock holding clamp 11 as by nuts 36*d* with the clamp extending between the pair of clamp pistons and crosswise of the stock feed path. A means such as O-rings are provided to form a seal between the cylinder 36 and the sealing gland 37 and also to form a sliding seal between the periphery of the clamp piston 12*a* in the cylinder and between the rod 12*b* and the sealing gland. The fluid pressure operated means 12 for the stock holding clamp are preferably of the double acting type with a first fluid pressure chamber 36*a* formed in the cylinders 36 at the underside of the pistons 12*a* and a second fluid pressure chamber 36*b* formed in the cylinder at the upper or rod side of the pistons. Each piston 12*a* is advantageously formed with a shoulder 12*d* spaced above its upper side and arranged to engage the sealing gland 37 and to limit upward travel of the piston as shown in FIG. 2.

The main control valve 19 is arranged to control the application of fluid pressure to the fluid pressure operated means 12 for the stock holding clamp and the fluid actuators 15 for the stock feed clamps. As best shown in FIGS. 2 and 4, a main valve cylinder 41 is formed in the body 10 and is closed at its lower end and opens at the upper side of the body. An annular main valve casing member 42 is positioned in the lower end of the cylinder 41 and an annular sealing gland 43 is provided in the upper portion of the cylinder and is retained therein by a split ring 44. The valve casing member 42 defines an internal valve chamber having a main valve inlet port 42*a* at its lower end and a main valve exhaust port 42*b* at its upper end. The valve member has an external annular recess that defines a main internal valve control port 42*c* and upper and lower passage means 42*d* and 42*e* that communicate the valve chamber with the main valve control port at axially spaced locations. A cylindrical main valve member 44 is slidably mounted in the valve casing member 42 and is movable from a first position shown in FIG. 2 communicating the main valve inlet port 42*a* with passage 42*e* and control port 42*c* while blocking the main valve exhaust port 42*b*, to a second position communicating the main valve exhaust port 42*b* with passage 42*d* and control port 42*c* while blocking main valve inlet port 42*a*.

The main bore 20 extends parallel to the stock feed path from one end 10*e* to the opposite end 10*f* of the body. The feed cylinder means 16 is disposed in a first end portion of the main bore 20 and the fluid pressure operated auxiliary control valve means 18 is mounted in a second portion of the main bore 20 for controlling supply and exhaust of fluid pressure to the feed piston 17. The fluid pressure operated auxiliary control valve means 18 includes valve casing means 51 having a cylindrical outer periphery dimensioned to be slidably received in the main bore 20. The inner end 51*a* of the valve casing means defines a cylinder head at one end of the cylinder means 16 and a means such as a split ring 52 engages the outer end 51*b* of the valve casing means to removably retain the valve casing means in the second portion of the main bore. The valve casing means defines a control chamber 53 adjacent the inner end 51*a* of the valve casing means, a valve actuator cylinder means 54 intermediate the control chamber 53 and the outer end 51*b* of the valve casing means, and an auxiliary valve chamber 55 intermediate the valve actuator cylinder means 54 and the outer end 51*b* of the valve casing means. A tube 56 extends lengthwise of the main bore 20 and has one end fixed in an opening 57 in the inner end of the valve casing means. The tube communicates at one end with the control chamber 53 and slidably extends into the passage 17b in the piston and piston rod with the second end of the tube communicating with that passage to supply fluid pressure from control chamber 53 to the pistons 15a on the feed head 13. In this embodiment, the valve casing means includes an outer casing body with the control chamber 53 and opening 57 formed by bores therein concentric with the outer periphery of the valve casing body. The valve actuator cylinder means 54 and the auxiliary valve chamber 55 are formed in a stepped bole that is eccentric to the outer casing body. The valve actuator cylinder means 54 communicates at one end with the control chamber 53 and a valve actuator piston 58 is slidably disposed in the cylinder 54 with the blind end of the piston exposed to the fluid pressure in the control chamber. The auxiliary valve chamber 55 is formed by a ring 61 that is disposed in a counterbore in the outer casing body and which has a stepped inner bore defining an auxiliary valve outlet port 61a with a chamfered valve seat around the outlet port. A head member 63 is disposed in the outer end of the counterbore in the outer casing body and extends into the stepped bore in the ring member 61. The head member 63 has an auxiliary valve inlet port 63a formed therein coaxial with the outlet port 61a and an annular chamfered seat around the inlet port. An auxiliary valve control port 61b is formed in the annular member 61 at a location intermediate the auxiliary valve inlet port 63a and the auxiliary valve outlet port 61a. An auxiliary valve member 65, conveniently in the form of a disk having a thickness less than the spacing between the auxiliary inlet and outlet ports, is disposed in the auxiliary valve chamber 55 and fluid pressure at the inlet port 63a acting on one side of the disk normally urges the disk to a position engaging the seat around the auxiliary valve outlet port 61a. The valve actuator piston 58 has an extension 58a that engages the other side of the valve member 65 and the valve actuator piston is operative, when pressure is supllied to the blind end of the piston 58, to move the auxiliary valve member to a position blocking flow from the auxiliary valve inlet port 63a to the auxiliary valve control port 61b and establishing communication between the auxiliary valve control port 61b and the auxiliary valve outlet port 61a. As best shown in FIGS. 6–9, the extension 58a on the valve actuator piston 58 has a sliding seal with the inner bore of the ring member 61. A means described more fully hereinafter is provided for venting the area at the rod side of the valve actuator piston 58 to atmosphere. The auxiliary valve member 65 and the valve actuator piston 58 are preferably formed of a resilient synthetic resin material. The auxiliary valve member may, for example, be formed of nylon and the auxiliary valve actuator piston 58 formed of a polycarbonate plastic such as "Lexan".

The main body 10 is conveniently formed of an easily machinable material such as aluminum and, in accordance with another aspect of the present invention, the feed cylinder means 16 is advantageously formed by a sleeve 91 of a wear resistant material such as stainless steel, and which is disposed in one portion of the bore 20 between the valve casing 51 and an annular head member 92. As best shown in FIG. 6, the valve casing member 51 is formed with a reduced diameter inner end portion 51c and one end of the sleeve 91 is adapted to be press fit on and sealed to the inner end portion of the auxiliary valve casing member. The cylinder head member 92 is removably mounted on the bore and has a reduced diameter portion 92a adapted to receive and center the other end of the sleeve 91. The piston rod slidably extends through the cylinder head member 92 and a means such as an O-ring is provided to form a sliding seal between the cylinder head member and the piston rod with a second O-ring at the outer periphery of the cylinder head member to form a seal with the cylinder bore 20. The cylinder head member is removably retained in the bore as by a split ring 94 and a lubricant retaining wiper 96 is disposed in the bore around the piston rod.

The cylinder sleeve has an outer diameter sufficiently smaller than the bore 20 to define a pressure chamber 98 in the bore and around the sleeve. The cylinder head member is formed with one or more recesses 92b (FIG. 6) that are arranged to communicate the pressure chamber 98 with the interior of the sleeve at the rod side of the piston, to supply fluid pressure to the rod side of the piston and bias the latter in one direction. As previously described, the auxiliary control valve means 18 controls the application of fluid pressure to the other face of the piston 17 to effect movement of the piston in the other direction.

The body is formed with pressure supply passage means having an inlet 71 adapted for connection to a source of fluid pressure such as a compressed air supply. The pressure supply passage means is arranged to supply fluid pressure to the rod end of the feed piston; to the second fluid pressure chambers 36b of the clamp pistons; to the fluid pressure inlet 42a of the main control valve, and to a preselected location in the second portion of the main bore 20. The chamber between the sleeve 91 and the main bore 20 is utilized as a portion of the pressure distribution passage. As best shown in FIG. 6, the pressure distribution passage includes a bore 71a extending from the inlet 71 and communicating with the bore 20 externally of the sleeve 91. The bore 71a is arranged to communicate with the upper fluid pressure chamber 36b for one of the clamp pistons 12a, and an extension 71b of the bore is arranged to communicate the pressure chamber between the sleeve 91 and main bore 20 with the upper fluid pressure chamber for the other clamp piston. The outer end of the bore 71b is closed as by a plug 71c. Fluid pressure is also supplied from the inlet through a bore 71d to the inlet 42a of the main control valve, as best shown in FIGS. 4 and 6.

The valve body also has an exhaust outlet 73 and exhaust passage means for communicating the exhaust outlet with the exhaust port 42b of the main control valve and the second portion of the bore. As shown in FIG. 6, the exhaust passage means is conveniently formed by a bore 73a that extends from the exhaust outlet to the main bore 20 to communicate with the latter at a preselected location therein, and by a second bore 73b that extends in from the other side of the body and intersects the main bore 20 at a location transversely aligned with the location at which the passage 73a intersects the bore. The bore 73b, however, is disposed at a level and at a location to also intersect the main valve cylinder 41 and communicate with the exhaust outlet port 42d in the main valve body as shown in FIG. 4. The outer end of bore 73b is closed as by a plug 73c. An adjustable throttling valve 74, conveniently in the form of a screw threadedly adjustable in a bore 74a disposed crosswise of the exhaust passage 73a as best shown in FIGS. 5 and 6, is advantageously provided in the outlet of the exhaust passage means to adjust the rate of movement of the feed piston. A muffler (not shown) can be provided in the outlet of the exhaust passage means to reduce noise of exhaust air.

The body 10 is also formed with main control passage means for communicating the main valve control port 42c of the main control valve with the pressure chambers 36a of the clamp pistons and with the main bore 20 at a thrrd location along the second portion of the main bore. As best shown in FIG. 5, the control passage means includes bores 75a and 75b drilled in from the end 1Of of the body parallel to the cylinder bore 20 and at locations to intersect the fluid pressure chambers 36a at the underside of the clamp pistons 12a. The outer end of the bores 75a and 75b are closed as by plugs 75c and 75d. The control passage means also includes a bore 75e that extends in from the side 1Od of the body at a level to intersect the main valve control port of the main control valve and also intersect the bore 75a and the main bore 20 at a third preselected location along the main bore. Bore 75e is extended at the other side of the main bore 20 as indicated at 75f to intersect the bore 75b. The outer end of the bore 75e is closed as by a plug 75g.

Figure 7:
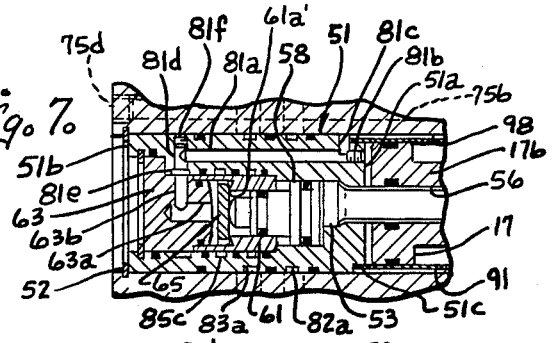
FIG. 7 is a fragmentary sectional view taken on the broken plane 7-0-X of FIG. 5.

As best shown in FIG. 7, the valve casing means 51 has a first passage means therein for communicating the auxiliary valve inlet port 63a with the main pressure supply passage means. This is advantageously achieved by a bore 81a that extends in from the inner end 51a of the valve casing means 51 and which is closed at its inner end by a plug 81b. A notch 81c is formed in the periphery of the valve casing means at a location adjacent the end of the cylinder sleeve 91, and of a depth to intersect the passage 81a so as to supply fluid pressure from the pressure chamber 98 between the sleeve 91 and main bore 20 to the passage 81a. A transverse bore 81d is provided in the valve casing means 51 and communicates the end of the bore 81a with a annuiar pressure distribution groove 81e formed in the inner periphery of the stepped bore in the valve casing means 51. The outer end of transverse bore 81d is closed as by a plug 81f and the head member 63 has a transverse bore 63b that is arranged to supply pressure from the pressure distribution groove 81e to the auxiliary valve inlet port 61a.

Figure 8:
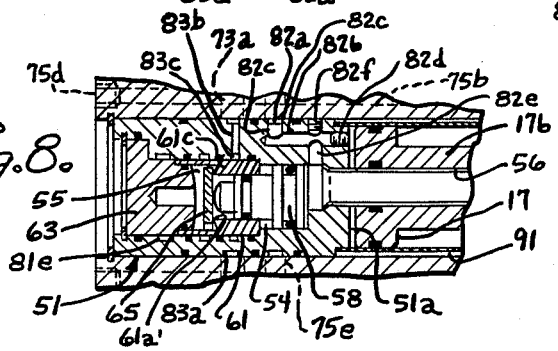
FIG. 8 is a fragmentary sectional view taken on the broken plane 8-0-X of FIG. 5.

The valve casing means 51 also has auxiliary control passage means for communicating the control chamber 53 with the main control passage means in the valve body. As best shown in FIG. 8, the valve casing means has a peripheral pressure distribution groove 82a arranged to communicate with the control passages 75e and 75f at the location where they intersect the main bore 20, to transmit fluid pressure from passage 75e to passage 75f. The valve casing means 51 also has a bore 82b extending in from the inner end 51a and a transverse bore 82c that communicates in the inner end of bore 82b with the pressure distribution groove 82a. The inner end of bore 82b is closed by a plug 82d. A transverse bore 82e in the casing means communicates the bore 82b with the control chamber 53 and the outer end of the bore 82e is closed by a plug 82f.

Auxiliary exhaust passage means are formed in the valve casing means 51 to communicate main exhaust passages 73a and 73b with each other and to also communicate the auxiliary valve outlet port with the exhaust passage means in the body. As best shown in FIG. 8, the auxiliary exhaust passage means includes an external annular pressure distribution groove 83a in the periphery of the valve casing means 51 at a location to communicate with the exhaust passage bores 73a and 73b. A transverse bore 83b is formed in the valve casing means 51 to communicate the external pressure distribution groove 83a with an internal pressure distribution groove 83c. Ring member 61 is formed with a passage 61c that communicates the auxiliary exhaust outlet post 61a with the pressure distribution groove 83c and hence through bore 83b and pressure distribution groove 83a with exhaust passage means in the body.

Auxiliary control passage means are also provided in the valve casing means 51 to communicate the auxiliary control port with the cylinder means at the blind end of the piston. As shown in 6, the auxiliary control passage means include a bore 85a that extends in from the inner end 51a of the valve casing means and a transverse bore 85b that communicates the inner end of th bore 85a with an internal pressure distribution groove 85c. The outer end of bore 85b is closed by a plug 85d. The pressure distribution groove 85c is arranged to communicate with the control outlet port 61b.

Figure 9:
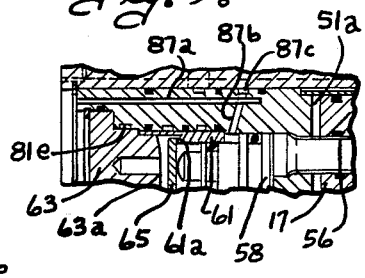
FIG. 9 is a fragmentary sectional view taken on the broken plane 9-0-X in FIG. 5.

In this embodiment, the valve casing means is provided with a separate vent for the rod side of the valve actuating piston 58. As shown in FIG. 9, a bore 87a extends in from the outer end of the valve casing means 51 and a transverse bore 87b communicates the inner end of the bore 87a with the valve cylinder at the rod side of the valve piston. The outer end of the bore 87b is closed as by a plug 87c. With this arrangement, the rod side of the valve actuating piston 58 is vented to atmosphere, independent of any back pressure in the main exhaust passage means.

The main control valve 44 has a stem 44a that extends upwardly through the sealing gland 43 and has an overtravel actuator 101 at its upper end. The fluid pressure at main valve inlet part 42a normally urges the main control valve to a raised position communicating the inlet port with the control port 42c and the main valve member is operable to its second position in response to pressure applied to the upper end of the valve stem 44a. As disclosed in the aforementioned U.S. Pat. No. 3,038,645, the overtravel actuator 101 includes a head 101a on the upper end of the valve stem and a cup shaped member 101b having an open lower end slidably supported on the head 101a and sealed thereto as by an O-ring 101c. Stem 44a has an axial passage 44b therethrough communicating at its lower end with the main valve inlet port 42a and at its upper end with the interior of the cup-shaped member 101b to normally urge the cup-shaped member to a raised position. A means such as a split ring 102 limits upward movement of the cup-shaped member relative to the head 101a. Thus, fluid pressure is supplied to the cup-shaped member to normally urge it to a raised position and, when a downward force is applied to the upper end of the cup-shaped member 101b as by press ram, it initially moves the main control valve downwardly to its second position and further depression of the cup-shaped member accommodates overtravel of the press ram.

Figure 11:
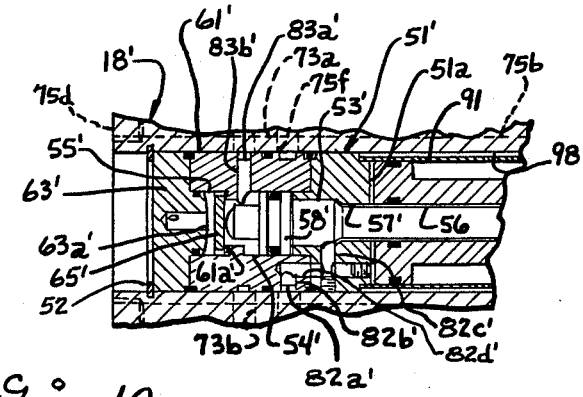
FIG. 11 is a fragmentary sectional view taken on the plane 11-0-11 of FIG. 10.
Figure 10:
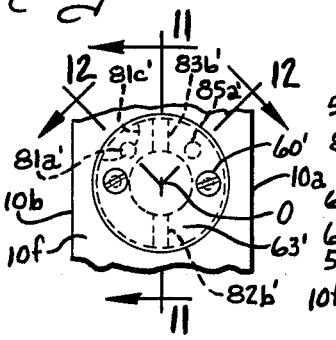
FIG. 10 is a fragmentary end elevational view of a modified form stock feed apparatus.
Figure 12:
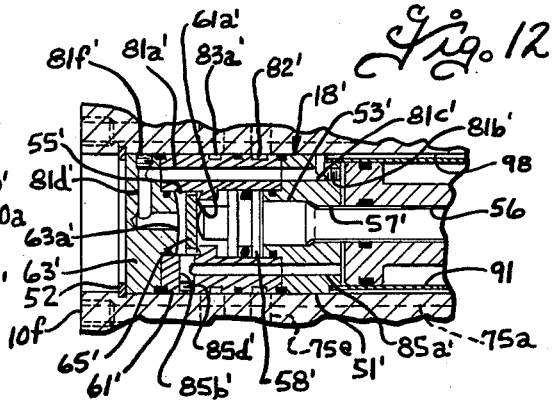
FIG. 12 is a fragmentary sectional view taken on the broken plane 12-0-12 of FIG. 10.

FIGS. 10–12 illustrate a modified form of fluid pressure operated auxiliary valve means 18'. In this embodiment, like numerals are used to designate the same parts and like numerals followed by the postscript ' are used to designate modified parts. The valve casing means includes casing sections 51', 61' and 63' secured together in end-to-end relation as by lengthwise extending fasteners 60' (FIG. 10). The auxiliary casing means is removably disposed in a second portion of the main bore 20 in the main body and retained therein as by a split ring 52. The casing means defines a control chamber 53' adjacent the inner end 51*a'* of the casing means and the tube 56 is fixed to the auxiliary valve casing means in an opening 57'. The valve actuator cylinder means 54' is formed in one end of the member 61' and the auxiliary valve chamber 55' and auxiliary outlet port 61*a'* are formed at the other end of the member 61'. The head member 63' has a reduced diameter portion that closes one end of the auxiliary valve chamber and which has the auxiliary valve inlet port 63*a'* formed therein. An auxiliary valve member 65' is disposed in the chamber 55' and is normally biased by fluid pressure at the inlet port 63*a'* to a position blocking flow through auxiliary valve outlet port 61*a'*. A valve actuating piston 58' is slidable in the cylinder means and is operative in response to fluid pressure in the control chamber 53' to move the auxiliary valve member to a position blocking flow through the auxiliary valve inlet port 63*a'*.

In this embodiment, the control chamber 53', cylinder 54', and auxiliary valve chamber 55' are disposed coaxially of the bore 20. As best shown in FIG. 11, the casing means 51' is formed with a peripheral pressure distribution groove 83*a'* arranged to communicate with the exhaust outlet passages 73*a* and 73*b* in the body. The transverse bore 83*b'* in the member 61' communicates the pressure distribution groove 83*a'* with the valve outlet port 61*a'*. As also shown in FIG. 11, the member 61' has a second peripheral distribution groove 82*a'* arranged to communicate with the main control passages 75*e* and 75*f* at the location where they intersect the bore 20 and passages 82*b'*, 82*c'* and 82*d'* are formed in the members 61' and 51' to communicate tne pressure distribution groove 82*a'* with the control chamber 53'. As shown in FIG. 12, the auxiliary inlet port 63*a'* communicates through transverse bore 81*d'*, lengthwise extending bore 81*a'*, and transverse recess 81*c'* with the pressure chamber 98 between the bore 20 and the cylinder sleeve 91, to supply fluid pressure to the auxiliary inlet port. Transverse bore 81*d'* is closed by a plug 81*f'* and lengthwise extending bore 81*a'* is closed by a plug 81*b'*. The auxiliary valve chamber 55' communicates through transverse bore 85*b'* and lengthwise extending bore 85*a'* with the end of the feed cylinder. The outer end of bore 85*b'* is closed by a plug 85*d'*.

From the foregoing, it is believed that the construction and operation of the stock feed apparatus will be readily understood. In both embodiments, the feed cylinder means is located in a first portion of the bore 20 in the body and the fluid pressure operated auxiliary valve means is located in a second portion of the bore 20 for applying and exhausting fluid pressure to the feed piston. The fluid pressure operated valve means including the valve casing means, auxiliary valve member, and piston actuator for the auxiliary valve member can be installed and removed as a unit from the bore. This construction reduces and simplifies the number of different passages that must be formed in the body 10 and reduces the overall cost of manufacture since the auxiliary valve means including the auxiliary valve casing means, auxiliary valve member and valve operating piston as well as the various passages and ports in the auxiliary valve casing means can be formed on conventional screw machines.

The stock feed apparatus is adapted to be mounted on a punch press as by bolts or fasteners that extend through mounting holes in the body 10. The inlet of the fluid pressure passage means 71 is connected to a source of gaseous fluid pressure such as the plant air supply, and air under pressure is continuously supplied through passages 71*a* and 71*b* to the pressure chamber around the sleeve and to the upper chambers 36*b* of the fluid pressure actuators for the stock holding ciamp to bias the stock holding clamp downwardly to a stock engaging position. Fluid pressure is also continuously supplied through passage 71*d* to the inlet at the lower end of the main control valve and this normally biases the main control valve to a raised position. When the main control valve is in its raised position, it supplies fluid pressure through main valve control port 42*c* and main control passages 75*a*, 75*b*, 75*e* and 75*f* to the lower chambers 36*a* of the clamp actuating cylinders. The effective area of the rod end face of the clamp pistons 12*a* is smaller than the area at the lower face of the clamp pistons and, when fluid pressure is supplied to chamber 36*a*, it moves the clamp pistons upwardly to move the stock clamp to its raised or stock release position. When the main control valve supplies fluid pressure to the main control passages, it also pressurizes control chamber 53 by way of pressure distribution groove 82*a*, and passages 82*b*, 82*c*, and 82*e*, and supplies fluid pressure through tube 56 to the pistons in the pressure chambers 34*a* in the feed head to move the feed clamp downwardly to a stock engaging position. When fluid pressure is applied to the control chamber 53, it also actuates valve actuating piston 58 to move the auxiliary control valve 65 to a position blocking flow through the auxiliary valve inlet port 63*a* and communicating the auxiliary valve control port with the auxiliary valve outlet port. Thus, under these conditions, fluid pressure is exhausted from the end of the feed cylinder opposite the rod 17*a* and the feed piston is moved to the left as viewed in FIG. 6 under the fluid pressure applied to the rod end face of the feed piston.

When the main control valve is moved down to its second or lower position as shown in FIG. 4, it communicates the main control port 42*c* with the main exhaust port 42*b*. Under these conditions, fluid pressure is exhausted from the chambers at the lower side of the clamp pistons 12*a* so the clamp pistons move downwardly under the fluid pressure that is continuously supplied to the upper rod end face of the clamp pistons. When the control valve is in its second position, it also exhausts fluid pressure from the upper chambers of the stock feed cylinders and springs 32 then move the stock feed clamp upwardly to a stock release position. When the main control valve is in its second position, it also exhausts fluid pressure from the control chamber 53 and fluid pressure on the opposite end of the auxiliary valve member 65 moves the auxiliary valve member and valve actuating piston to the position shown in FIG. 6 in which the auxiliary valve member communicates the auxiliary valve inlet port with the auxiliary valve control port and closes the auxiliary valve outlet port. Fluid pressure is then supplied to the end of the feed cylinder to move the feed piston and feed head to the right as viewed in FIG. 6. Thus, the stock holding clamp is moved to a stock engaging position and the stock feed clamp is moved to a stock release position just prior to extension of the feed head (to the right as viewed in FIG. 6). The stock holding clamp is moved to its release position and the stock feed clamp to a stock engaging position when the feed head is retracted to the left as viewed in FIG. 6. As will be seen, the length of the stroke of the feed head and hence the length of the stock feed can be adjusted by the adjustable stop 25. As previously described, the stock guides are laterally adjustable to accomodate stock of different widths.

In the stock feed apparatus disclosed herein, it is only necessary to machine one main bore in the body for both the feed piston and the auxiliary valve means. The auxiliary valve means including the auxiliary valve casing members and auxiliary valve member and valve actuator can easily be formed on the screw machines and thereafter assembled as a unit in the bore 20. Mounting the auxiliary valve in the same bore with the feed cylinder also reduces and simplifies the number of passages that must be formed in the main body. The provision of a sleeve for the feed piston not only reduces wear problems but also simplifies the passage arrangement for supplying fluid pressure to the rod end of the cylinder. As shown, substantially all the passages can be easily formed by drilling holes that are orthogonal to the axis of the feed cylinder.

The embodiments of the invention in which an exclusive property or privilege is claimed are defined as follows:

1. A stock feed apparatus for intermittently advancing strip stock along a feed path comprising, a body having a main bore therein generally paralleling the feed path, cylinder means in a first portion of the main bore and fluid pressure operated valve means in a second portion of the main bore, said fluid pressure operated valve means including valve casing means removably disposed in said second portion of said main bore and having an inner end defining a cylinder head at one end of the cylinder means, and an outer end remote from said cylinder means, auxiliary valve means in said valve casing means for applying and exhausting fluid pressure from said one end of the cylinder means, a feed piston mounted for axial reciprocation in the cylinder means and having a piston rod extending from one side of the piston and out of a second end of the cylinder means, the piston having a rod end face at said one side and a main end face at the other side larger than said rod end face, a feed head on the piston rod external of said cylinder means, a feed clamp mounted on the feed head and a first fluid pressure operated means on the feed head for moving the feed clamp from a stock release to a stock engaging position, a stock holding clamp mounted on the body and a second fluid pressure operated means on the body for moving the stock holding clamp from a stock engaging position to a stock release position, the feed piston and piston rod having an axial passage extending through the piston and into the piston rod and communicating at the end remote from the piston with said first fluid pressure operated means, a tube having a first end fixed to said valve casing means adjacent said inner end of the valve casing means, the tube slidably extending into the passage in the piston and piston rod and having a second end communicating with that passage, the body having pressure suppiy passage means therein adapted for connection to a source of fluid pressure and communicating with said main bore at a first location therein, the body having exhaust passage means therein and communicating with said main bore at a second location therein, the body having a main control passage means therein communicating with said second fluid pressure operated means and with said main bore at a third location therein, a main control valve means including a main valve chamber in the body having a main valve inlet port communicating with said pressure supply passage means and a main valve exhaust port communicating with said exhaust passage means and a main valve control port communicating with said main control passage means in the body, said main control valve means including a main control valve member in the main valve chamber movable from a first position communicating the main valve control port with the main valve inlet port and a second position communicating the main valve control port with the main valve exhaust port, said valve casing means including means defining a control chamber therein at a location intermediate said first end of the tube and said outer end of the valve casing means and communicating with said first end of the tube, said valve casing means including means defining an auxiliary valve chamber therein at a location intermediate said control chamber and said outer end of said valve casing means, said auxiliary valve chamber having an auxiliary valve inlet port and an auxiliary valve outlet port and an auxiliary valve control port, said valve casing means having a first passage means communicating the auxiliary valve inlet port with said pressure supply passage means at said first location in the main bore, said valve casing having second passage means communicating said auxiliary valve outlet port with said exhaust passage means at said second location in the main bore, said valve casing means having third passage means therein communicating said control chamber with said main control passage means at said third location in the main bore, said valve casing means having auxiliary control passage means communicating said auxiliary valve control port with said cylinder means to apply and exhaust fluid pressure from the main end face of the piston, said pressure operated valve means including an auxiliary valve member in said auxiliary valve chamber movable between a first position communicating said auxiliary valve control port with said auxiliary valve inlet port and a second position communicating said auxiliary valve control port with said auxiliary valve outlet port, and pressure operated valve actuating means in said valve casing means and responsive to the pressure in said control chamber for moving said auxiliary valve member from said first to said second position when the main control valve supplies fluid pressure to the control chamber.

2. A stock feed apparatus according to claim 1 wherein said valve casing means includes means defining an operator cylinder means intermediate said control chamber and said auxiliary valve chamber, said pressure operated valve actuating means including a valve operating piston member slidable in said operator cylinder means and engaging said auxiliary valve member.

3. A stock feed apparatus according to claim 2 wherein said operator cylinder means has an axis coaxial with said main bore.

4. A stock feed apparatus according to claim 2 wherein said operator cylinder means has an axis parallel to and radially spaced from the axis of the main bore.

5. A stock feed apparatus according to claim 1 wherein said cylinder means includes a sleeve in said first portion of the main bore having one end attached to said inner end of the valve casing means, said sleeve having an outer diameter smaller than the cross-section of the first portion of the main bore to define a fluid pressure chamber therebetween, said pressure supply passage means communicating with the main bore externally of said sleeve, said cylinder means including means communicating said fluid pressure chamber with said cylinder means to apply fluid pressure to said rod end face of the piston.

6. A stock feed apparatus according to claim 1 wherein the auxiliary valve inlet port is arranged to apply fluid pressure to the auxiliary valve member when the latter is in its second position to normally bias the auxiliary valve member in a direction away from its second position, said pressure operated valve actuating means being arranged to move the valve member to its second position when the main control valve is operated to supply fluid pressure to the control chamber.

7. A stock feed apparatus according to claim 1 wherein the auxiliary valve chamber has first and second end faces disposed transverse to the axis of said main bore and spaced apart axially thereof with said first end face at the end of the auxiliary valve chamber remote from the cylinder means and the second end face at the end of the auxiliary valve chamber nearest to the cylinder means, said auxiliary valve inlet port being formed in said first end face of the auxiliary valve chamber and said auxiliary valve outlet port being formed in said second end face of the auxiliary valve chamber, said auxiliary valve member having first and second end faces extending transverse to the axis of said main bore and spaced apart a distance less than the spacing of the first and second end faces of the auxiliary valve chamber to allow the auxiliary valve member to move axially in the auxiliary valve chamber between said first and second positions thereof, said pressure operated valve actuating means comprising an annular valve actuating piston having one side communicating with the control chamber.

8. A stock feed apparatus according to claim 1 wherein said valve casing means includes a plurality of casing members, and retaining means for holding said members in assembled relation for insertion and removal as a unit from said main bore.

* * * * *